US007922013B2

(12) United States Patent
Nguy et al.

(10) Patent No.: US 7,922,013 B2
(45) Date of Patent: Apr. 12, 2011

(54) TOOL STORAGE DEVICE

(75) Inventors: Chanwa Nguy, Cornelius, NC (US); Pei-Ying Lin, Taichung Hsien (TW)

(73) Assignee: Steelworks Hardware, LLC, Taichung (TW)

( * ) Notice: Subject to any disclaimer, the term of this patent is extended or adjusted under 35 U.S.C. 154(b) by 968 days.

(21) Appl. No.: 10/555,160

(22) PCT Filed: Oct. 26, 2005

(86) PCT No.: PCT/US2005/039395

§ 371 (c)(1),
(2), (4) Date: Jun. 15, 2007

(87) PCT Pub. No.: WO2006/047783

PCT Pub. Date: May 4, 2006

(65) Prior Publication Data

US 2010/0065519 A1 Mar. 18, 2010

(30) Foreign Application Priority Data

Oct. 26, 2004 (TW) ..... 93132333 A

(51) Int. Cl.
*A47F 7/00* (2006.01)

(52) U.S. Cl. ..... 211/70.6; 211/196

(58) Field of Classification Search ..... 211/70.6, 211/196, 165, 97, 69, 78, 163, 85.23, 169, 211/169.1, 107, 205
See application file for complete search history.

(56) References Cited

U.S. PATENT DOCUMENTS

| | | | | |
|---|---|---|---|---|
| 896,990 | A * | 8/1908 | Hill | 248/125.3 |
| 3,517,824 | A * | 6/1970 | Paque | 211/50 |
| 6,041,947 | A | 3/2000 | Heneveld | |

FOREIGN PATENT DOCUMENTS

| | | |
|---|---|---|
| DE | 19531866 | 2/1997 |
| EP | 1520729 | 4/2005 |
| GB | 1543383 | 4/1979 |

OTHER PUBLICATIONS

Supplementary Search Report for EP Patent Application No. 05825477.2 dated Feb. 27, 2009.

* cited by examiner

*Primary Examiner* — Jennifer E. Novosad
(74) *Attorney, Agent, or Firm* — Levenfeld Pearlstein, LLC

(57) ABSTRACT

A tool device is disclosed to include a hollow upright pivot shaft, coupling rings rotatably mounted on the hollow upright pivot shaft at different elevations, and support arms respectively coupled to the coupling rings and turnable with the respective coupling rings about the hollow upright pivot shaft, each support arm having a plurality of open receiving chambers respectively vertically cut through the top and bottom walls thereof for holding hand tools, each open receiving chamber having a front opening, a top opening connected to the top open side of the front opening, and a bottom opening.

10 Claims, 10 Drawing Sheets

Fig. 10A
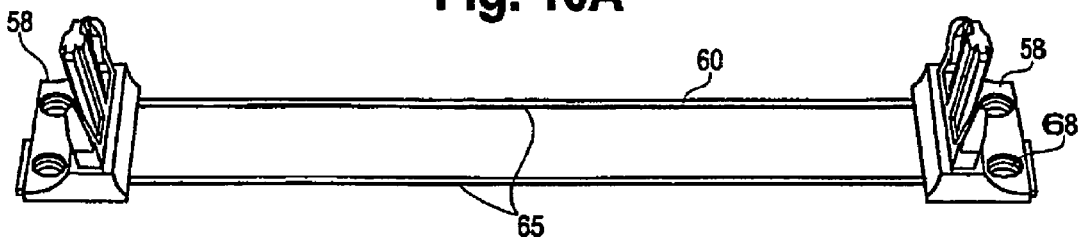
Fig. 10B
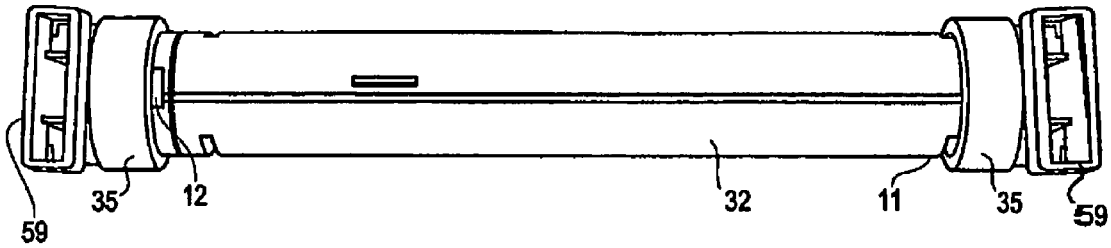
Fig. 11
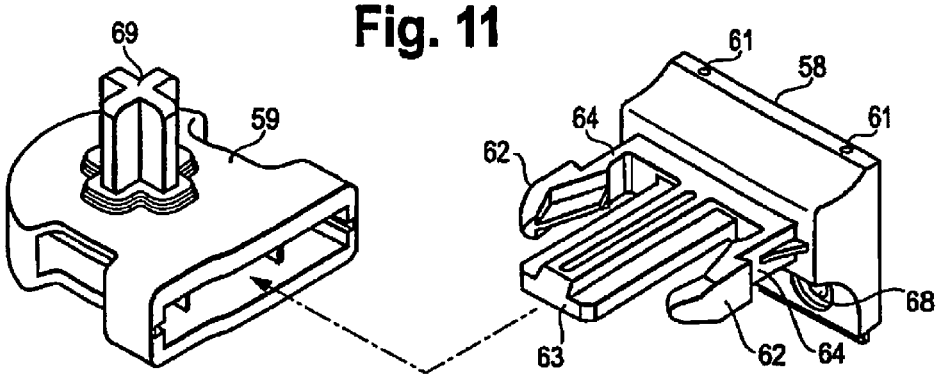
Fig. 12
Fig. 13
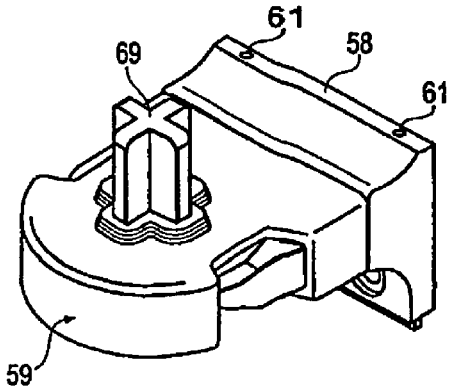
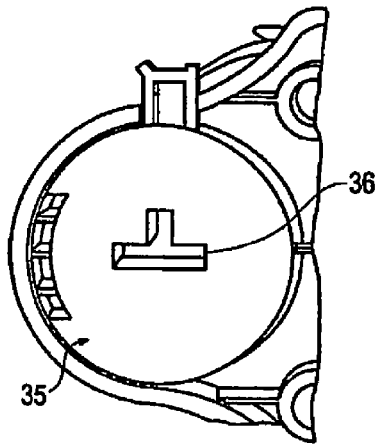

TOOL STORAGE DEVICE

FIELD OF INVENTION

This application claims the benefit of the Republic of China (Taiwan) Application No. 93132333, filed on Oct. 26, 2004.

The present invention relates to a tool storage device for large hand tools such as pliers, screwdrivers, wrenches, and related tools. The device comprises a hollow upright pivot shaft having a top end and a bottom end; both ends are end capped. A plurality of coupling rings are mounted on the hollow upright pivot shaft at different elevations, and a plurality of support arms are coupled to the coupling rings. The different elevations accommodate the storing of tools of various sizes.

BACKGROUND AND RELATED ART

A variety of tool cases and racks have been disclosed. The present invention provides a versatile, mobile tool storage device wherein support arms are coupled to coupling rings, which are mounted on the hollow upright pivot shaft. Each support arm has a proximal end and a distal end, also a front wall, a top wall, and a bottom wall. A plurality of open receiving chambers are cut through the top and bottom walls for holding hand tools. The prior art has not contemplated the inventive tool storage device with support arms coupled to the coupling rings mounted on the hollow upright pivot shaft. The support arms are mounted at different elevations to accommodate the storage of hand tools of different sizes. In one embodiment, at least one tool rack is coupled to coupling rings, which are mounted on the hollow upright pivot shaft. The prior art also has not contemplated an end capped hollow upright pivot shaft, wherein each end cap has plugholes for suitably connecting a fastening and a connecting structure to an upright surface such as a wall for ready storage. As background, the following references are discussed:

U.S. Pat. No. 6,705,655,132 to Yang discloses a tool rack with stacked racks having integral collars that pivot on a common shaft.

U.S. Pat. No. 6,241,092 to Vasudeva illustrates a snap-fit holder that permits a screwdriver to be vertically mounted.

U.S. Pat. No. 4,586,615 to Quitmann discloses a holder for an article to be used on a display device at the point of sale.

SUMMARY OF THE INVENTION

A novel tool storage device is provided for storing relatively large tools such as screwdrivers, pliers, and related items used by craftsmen in their daily tasks.

The tool storage device of this invention comprises a hollow upright pivot shaft having two ends. The hollow upright pivot shaft is end capped at both ends. A plurality of coupling rings are mounted on the hollow upright pivot shaft at different elevations, to enable the support arms to hold tools of varying sizes. Each support arm has a proximal end and a distal end. Each support arm also has a front wall, a bottom wall, and a plurality of open receiving chambers vertically cut through the top and bottom walls for holding hand tools. In an advantageous embodiment, the tool storage device, in addition to the support arms, has at least one tool rack for holding tools and a plurality of connectors adapted to pivotally connect at least one tool rack to the hollow upright pivot shaft. Each connector comprises a coupling ring pivotally connectable to the hollow upright pivot shaft, a flat arm for carrying one tool rack, a neck radially extended from the periphery of the coupling ring and terminating at the distal end of the flat arm. Furthermore, a first ridged portion is transversely provided at the proximal end of the flat arm and connected to the neck. A distal ridged portion is transversely provided at an opposite end of the flat arm and defines with the proximal ridged portion and the flat arm, a space for accommodating one tool rack.

In order to enable the craftsman to hang the tool storage device on a wall, the two ends of the hollow upright pivot shaft are end capped at both ends. Each end cap has a coupling wall and a plughole formed in the wall. A plurality of detachable connecting structures are provided each having a plug rod attached to each end cap through the plughole. A plurality of fastening structures are provided comprising a base having a plurality of apertures for fastening to an upright support structure. Each fastening structure comprises a coupling unit detachably connected to the connecting structure at the top and the bottom ends of the capped hollow upright pivot shaft.

BRIEF DESCRIPTION OF THE FIGURES

FIG. 10A illustrates detachable connecting and detachable fastening structures. In FIG. 10A, the structures are connected by two wires.

FIG. 10B illustrates the connecting and fastening structures connected to the hollow upright pivot shaft through the end cap.

FIG. 11 illustrates the detachable connecting structures and the detachable fastening structures as separate components.

FIG. 12 illustrates the connecting structure and fastening structure combined as one unit.

FIG. 13 illustrates either the top or bottom of the end cap of the hollow upright pivot shaft showing the plughole through which a plug rod of a connecting structure can be attached to the end cap. The plugholes are as shown.

DETAILED DESCRIPTION OF THE INVENTION

Figure 1:
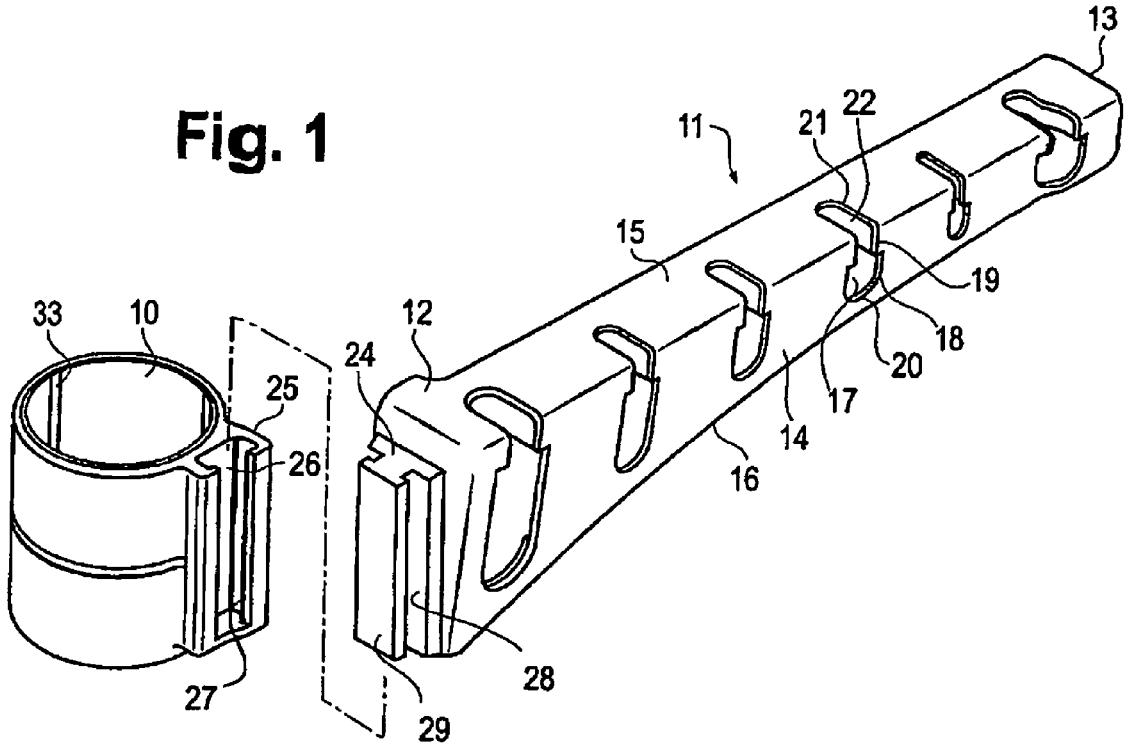
FIG. 1 is an exploded view of a part of the tool storage device of this invention showing the relationship between a coupling ring and a support arm.

The present invention relates to a tool storage device comprising a hollow upright pivot shaft having two ends, a top end and a bottom end. A plurality of coupling rings are mounted on the hollow upright pivot shaft at different elevations. A plurality of support arms are coupled to the coupling rings, each of the support arms has a proximal end, a distal end, a front wall, a top wall, and a bottom wall respectively extending perpendicularly from the top and the bottom sides of the front wall. A plurality of open receiving chambers are respectively vertically cut through said top and bottom walls for holding hand tools, each said open receiving chamber has a top opening in said top wall, and a bottom opening in said bottom wall.

Suitably, in the tool storage device, the front opening of each of the open receiving chambers has a top side opened and disposed in communication with the top opening of the respective open receiving chamber, and a bottom side closed. Advantageously, the open receiving chamber has a neck portion in the top opening. Each support arm has a male coupling block at the proximal end thereof for coupling one ring each coupling ring has a female coupling block at the periphery thereof for receiving the male coupling block of one support arm. Suitably, the male coupling block of each support arm has a T-shaped portion. The female coupling block of each coupling ring defines an upwardly extended T-groove for receiving the T-shaped coupling portion of the male coupling block of EACH support arm. Suitably, the male coupling blocks of the support arms can be respectively extended from the proximal end of the support arm at different angles. Conveniently, a plurality of spacers are mounted on the hollow upright pivot shaft between two adjacent coupling rings. In a preferred embodiment, each spacer has a clamp at the periphery thereof for holding a hand tool.

In the tool storage device of this invention, each coupling ring has a plurality of locating grooves spaced at equal angles around the inner diameter and axially extending to the top and the bottom sides thereof. The hollow upright pivot shaft comprises a plurality of spring strips longitudinally aligned on the periphery for holding the coupling rings in position. Each spring strip has a free end with a raised portion for engaging a locating groove of a coupling ring.

In the tool storage device of this invention, the hollow upright pivot shaft further comprises a rib provided at the periphery in line with and between two spring strips for engaging one locating groove of the coupling ring to stop the coupling ring from rotating relative to the hollow upright pivot shaft.

Advantageously, the open receiving chamber of each support arm and the top and the bottom openings of each open receiving chamber are made gradually smaller in the direction from the proximal end to the distal end. Also, each support arm has a thickness made gradually smaller in the direction from the proximal end to the distal end. The tool storage device of this invention also comprises a hollow upright pivot shaft having two ends, a top end and a bottom end, both end capped. An important feature of the tool storage device of this invention is that each end cap has a coupling wall and a plughole formed in the coupling wall. This feature enables connecting devices to be inserted in the plughole, which facilitate the hanging of the tool storage device to an upright surface, such as a wall. A plurality of coupling rings are mounted on the hollow upright pivot shaft at different elevations and a plurality of support arms are coupled to the coupling rings. Each of the support arms has an end proximal to the shaft, an end distal to the shaft, a front wall, a top wall, and a bottom wall respectively extending perpendicularly from the top and the bottom sides of the front wall. A plurality of open receiving chambers are vertically cut through the top and bottom walls for holding hand tools. Each open receiving chamber has a top opening in the top wall and a bottom opening in the bottom wall.

This invention is also directed to a tool storage device comprising support arms for holding screwdrivers and related tools and at least one tool rack for holding pliers, wrenches, and cutting devices.

The tool storage device comprises a hollow upright pivot shaft, a plurality of coupling rings respectively rotatably mounted on said hollow upright pivot shaft at different elevations, and a plurality of support arms coupled to said coupling rings, each support arm having an end proximal to the hollow shaft and an end distal from the hollow shaft. The support arms have a front wall, a top wall, and a bottom wall respectively extending perpendicularly from the top and the bottom sides of the front wall. The support arms have a plurality of open receiving chambers respectively vertically cut through the top and bottom walls for holding hand tools. Each open receiving chamber has a front opening in the front wall, a top opening in the top wall in communication with the front opening, a bottom opening in the bottom wall, and a neck portion in the top opening.

The tool storage device has at least one tool rack for holding tools such as pliers, wrenches, and cutting devices. The tool storage device of this invention has a plurality of connectors adapted to pivotally connect at least one tool rack to the hollow upright pivot shaft. Each connector comprises a coupling ring pivotally connected to the hollow upright pivot shaft. A flat arm is provided for carrying one said tool rack. A neck is provided which extends radially from the periphery of the coupling ring and terminates at the distal end of the flat arm.

A first ridged portion is transversely provided at the proximal end of the flat arm and is connected to the neck. A distal ridged portion is transversely provided at an opposite end of the flat arm and defines with the proximal ridged portion and the flat arm a space for accommodating one tool rack.

In a suitable embodiment, each tool rack has a recessed area in a bottom wall thereof, a plurality of protruding portions spaced from one another in said recessed area, and a plurality of finger grooves formed in the recessed area and separated from one another by the protruding portions. In a preferred embodiment, the tool storage device comprises one tool rack and two support arms. Suitably, screwdrivers and related tools are stored on the support arms and heavier tools such as pliers, wrenches, and cutting devices are stored on the tool rack.

Advantageously, each support arm has a male coupling block at the proximal end thereof for coupling to one said coupling ring and each said coupling ring has a female coupling block at the periphery thereof for receiving the male coupling block of one support arm. Suitably, the male coupling block of each support arm has a T-shaped coupling portion. The female coupling block of each said coupling ring defines an upwardly extended T-groove for receiving the T-shaped coupling portion of the male coupling block of one support arm. Preferably, the male coupling block of the support arms can extend from the proximal end of the support arms at different angles. For convenience of storing large tools, a plurality of spacers are mounted on the hollow upright pivot shaft between each two adjacent coupling rings. Optionally, each spacer has a clamp at the periphery thereof for holding a hand tool. Suitably, each coupling ring has a plurality of locating grooves spaced at equal angles around the inner diameter and axially extend to the top and the bottom sides. The hollow upright pivot shaft comprises a plurality of spring strips longitudinally aligned on the periphery in a line for holding the coupling rings in position. Each spring strip has a free end with a raised portion for engaging a locating groove of a coupling ring.

Suitably, the hollow upright pivot shaft further comprises a rib provided at the periphery in line with and between two of said spring strips for engaging one locating groove of one said coupling ring, to stop the rotation of the coupling ring relative to the hollow upright pivot shaft. Advantageously, the open receiving chamber, one for each support arm, and the top and the bottom openings of each open receiving chamber are made gradually smaller from the proximal end to the distal end. In similar manner, each support arm has a defined thickness gradually smaller from the proximal end to the distal end.

The instant invention comprises tool storage device capable of receiving devices for connecting and fastening, which enable the tool storage device to be connected to a wall. The tool storage device comprises a hollow upright pivot shaft having two ends. The hollow upright pivot shaft end is capped on the top and bottom ends with an end cap provided with coupling walls. A plughole is formed in the coupling wall. A plurality of coupling rings are provided and are respectively rotatably mounted on the hollow upright pivot shaft at different elevations. Suitably, a plurality of support arms coupled to said coupling rings are provided. Each support arm has a proximal end and a distal end, a front wall, a top wall, and a bottom wall respectively extending perpendicularly from the top and the bottom sides of the front wall. Each support arm has a plurality of open receiving chambers respectively vertically cut through the top and bottom walls for holding hand tools, each open receiving chamber having a front opening in said front wall, a top opening in said top wall in communication with said front opening, a bottom opening in said bottom wall, and a neck portion in said top opening. The tool storage device is provided with at least one tool rack for holding tools such as pliers, wrenches, and cutting tools. A plurality of connectors are adapted to pivotally connect at least one tool rack to the hollow upright pivot shaft. Each said connector comprises a coupling ring pivotally connectable to the hollow upright pivot shaft, a flat arm for carrying one tool rack, a neck radially extended from the periphery of the coupling ring, and terminates at the distal end of the flat arm. A first ridged portion is transversely provided at the proximal end of the flat arm and is connected to the neck, and a distal ridged portion is transversely provided at an opposite end of said flat arm and defined with proximal ridged portions and a flat arm for accommodating one tool rack. Each tool rack has a recessed area in a bottom wall thereof, a plurality of protruding portions spaced from one another in said recessed areas, and a plurality of finger grooves formed in the recessed area and separated from one another by protruding portions. In the preferred embodiment, the tool storage device comprises one tool rack and two support arms.

A tool storage device is disclosed that can be connected to a wall. The tool storage device comprises a hollow upright pivot shaft, having two ends, a top end, and a bottom end. Each end cap has a coupling wall and a plughole formed in the wall. A plurality of detachable connecting structures each having a plug rod attached to each end cap for connection through the plughole.

A plurality of fastening structures are provided which comprise a base having a plurality of apertures for fastening to an upright support structure. Each fastening structure comprises a coupling unit detachably connected to the connecting structure at the top and the bottom ends of the capped hollow upright pivot shaft.

The tool storage device has a plurality of coupling rings respectively mounted on the hollow upright pivot shaft at different elevations and a plurality of support arms respectively coupled to the coupling rings. Each of the support arms has a proximal end, a distal end, a front wall, a tap wall, and a bottom wall respectively extending perpendicularly from the top and the bottom sides of said front wall, and a plurality of open receiving chambers respectively vertically cut through said top and bottom walls for holding hand tools, each open receiving chamber having a top opening in said top wall, and a bottom opening in said bottom wall. At least one tool rack for holding tools is provided. The tool rack also includes a plurality of connectors adapted to pivotally connect at least one tool rack to the hollow upright pivot shaft, each said connector comprising a coupling ring pivotally connectable to the hollow upright pivot shaft, a flat arm for carrying one said tool rack, a neck radially extended from the periphery of the coupling ring and terminating at the distal end of the flat arm, a first ridged portion transversely provided at the proximal end of the flat arm and connected to the neck, and a distal ridged portion transversely provided at an opposite end of said flat arm and defines with the proximal ridged portion and the flat arm a space for accommodating one tool rack. Each tool rack has a recessed area in a bottom wall thereof, a plurality of protruding portions spaced from one another in said recessed area, and a plurality of finger grooves formed in the recessed area and separated from one another by the protruding portions.

The preferred tool storage device includes one tool rack and two support arms. Each support arm has a male coupling block at the proximal end for coupling to one said coupling ring. Each said coupling ring has a female coupling block at the periphery thereof for receiving the male coupling block of one said support arm. The male coupling block of each said support arm has a T-shaped coupling portion. The female coupling block of each said coupling ring defines an upwardly extended T-groove for receiving the T-shaped coupling portion of the male coupling block of one said support arm. The male coupling blocks of said support arms are respectively extended from the proximal end of the support arms at different angles.

The tool storage device is provided with a plurality of spacers respectively mounted on the hollow upright pivot shaft between each two adjacent coupling rings. Optionally, each spacer has a clamp at the periphery thereof for holding a hand tool.

Each coupling ring has a plurality of locating grooves spaced at equal angles around the inner diameter and axially extend to the top and the bottom sides thereto. The hollow upright pivot shaft comprises a plurality of spring strips longitudinally aligned on the periphery in a line for holding the coupling rings in position. Each spring strip has a free end with a raised portion for engaging a locating groove of a coupling ring.

The hollow upright pivot shaft includes a rib at the periphery thereof in line with and between a plurality of said spring strips for engaging a locating groove of a said coupling ring, to stop the rotation of the coupling ring relative to said hollow upright pivot shaft.

In the tool storage device, the open receiving chamber of each said support arm and the top and the bottom openings of each said open receiving chamber gradually diminish in diameter from said proximal end toward said distal end. Each support arm has a thickness that gradually diminishes in the direction from the proximal end to the distal end.

DETAILED DESCRIPTION OF THE FIGURES

Figure 2:
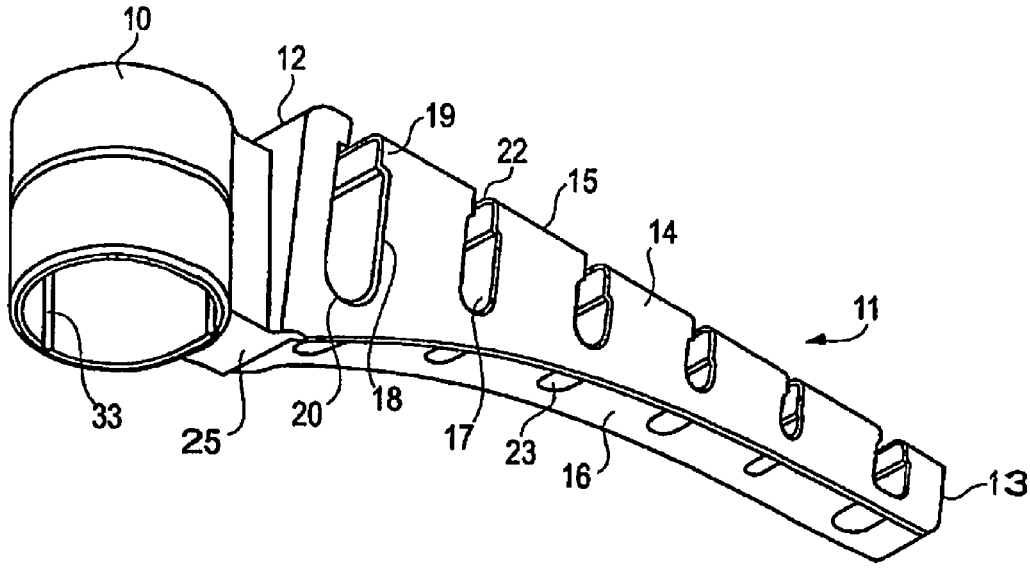
FIG. 2 is an assembly view of FIG. 1.

FIGS. 1 and 2 illustrate the relationship between coupling rings (10) and a support arm (11). The support arm (11) is formed of a frame bar having a proximal end (12) and a distal end (13), a front wall (14) extending between the proximal end (12), and the distal end (13), and a top wall (15) and a bottom wall (16) respectively extending from the top and the bottom sides of the front wall (14) at right angels between the proximal end (12) and the distal end (13). The support arm (11) has a thickness, which is reduced from the proximal end (12) toward the distal end (13). The support arm (11) has a plurality of open receiving chambers (17) respectively vertically cut through the top and the bottom walls (15), (16). Each open receiving chamber (17) has a front opening (18), which extends through the front wall (14) and has a top side (19) opened and a bottom side (20) closed. Each open receiving chamber (17) has a top opening (21), which extends through the top wall (15) and is disposed in communication with the opened top side (19) of the respective front opening (18). The open receiving chamber (17) has a neck portion (22) formed in the top opening (21). The bottom opening (23) of each open receiving chamber (17) is made gradually smaller in size in the direction from the proximal end (12) toward the distal end (13). The support arm (11) further comprises a male coupling block (24) at the proximal end (12) connectable to the female coupling block (25) at the periphery of a coupling ring (10). The male coupling block (24) is a T-block comprising a flat outer coupling portion (29) and a narrow inner connecting portion (28) connected between the flat outer coupling portion (29) and the proximal end (12) of the support arm (11). The female coupling block (25) of the coupling ring (10) has a single-open-end coupling groove (26) for receiving the flat outer coupling portion (29) of the male coupling block (24) and a narrow passage aperture (27) for passing the narrow inner connection portion (28) of the male coupling block (24) upon insertion of the flat outer coupling portion (29) into the single-open-end coupling groove (26).

Figure 3:
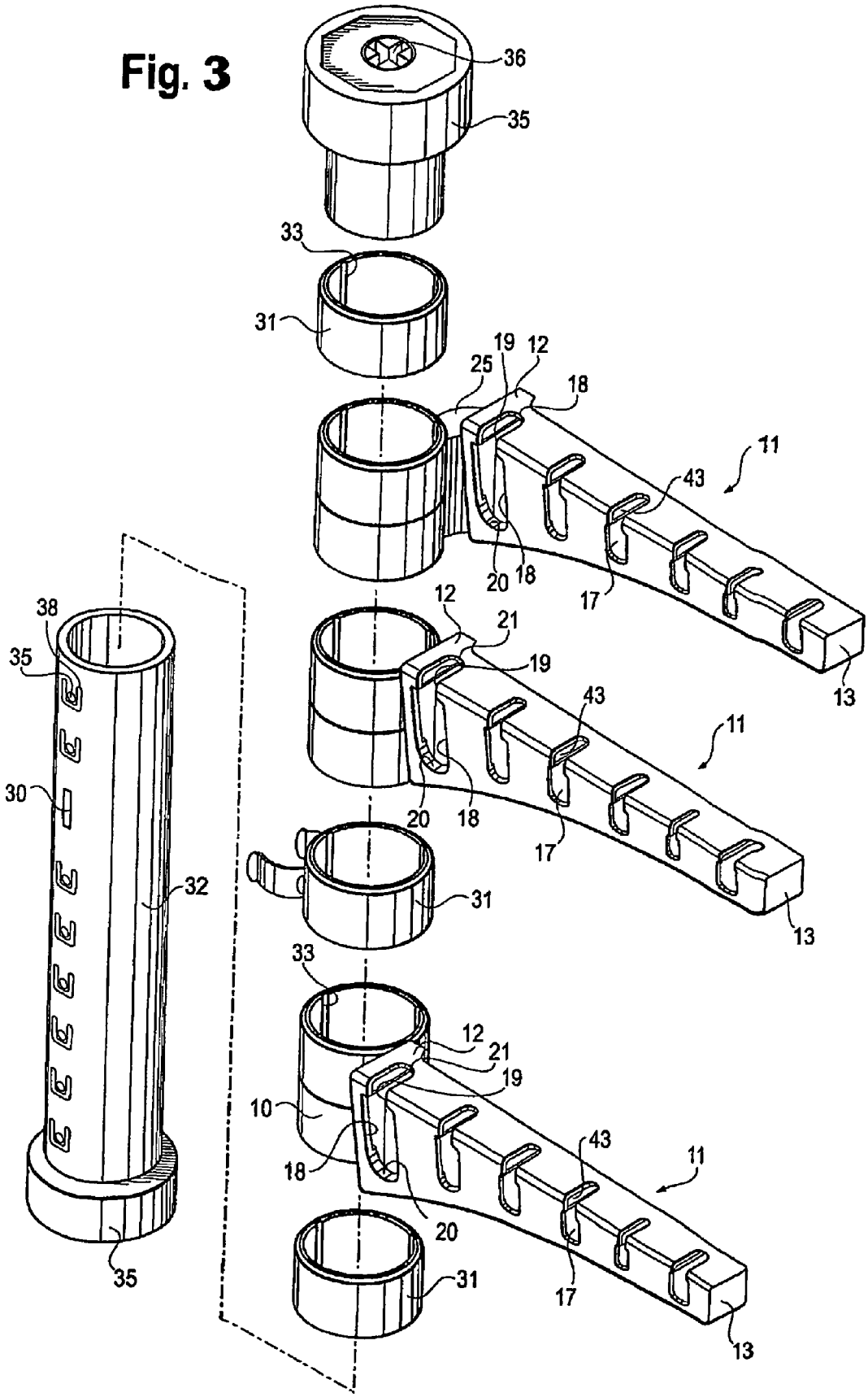
FIG. 3 is an exploded view of the tool storage device of this invention.
Figure 4:
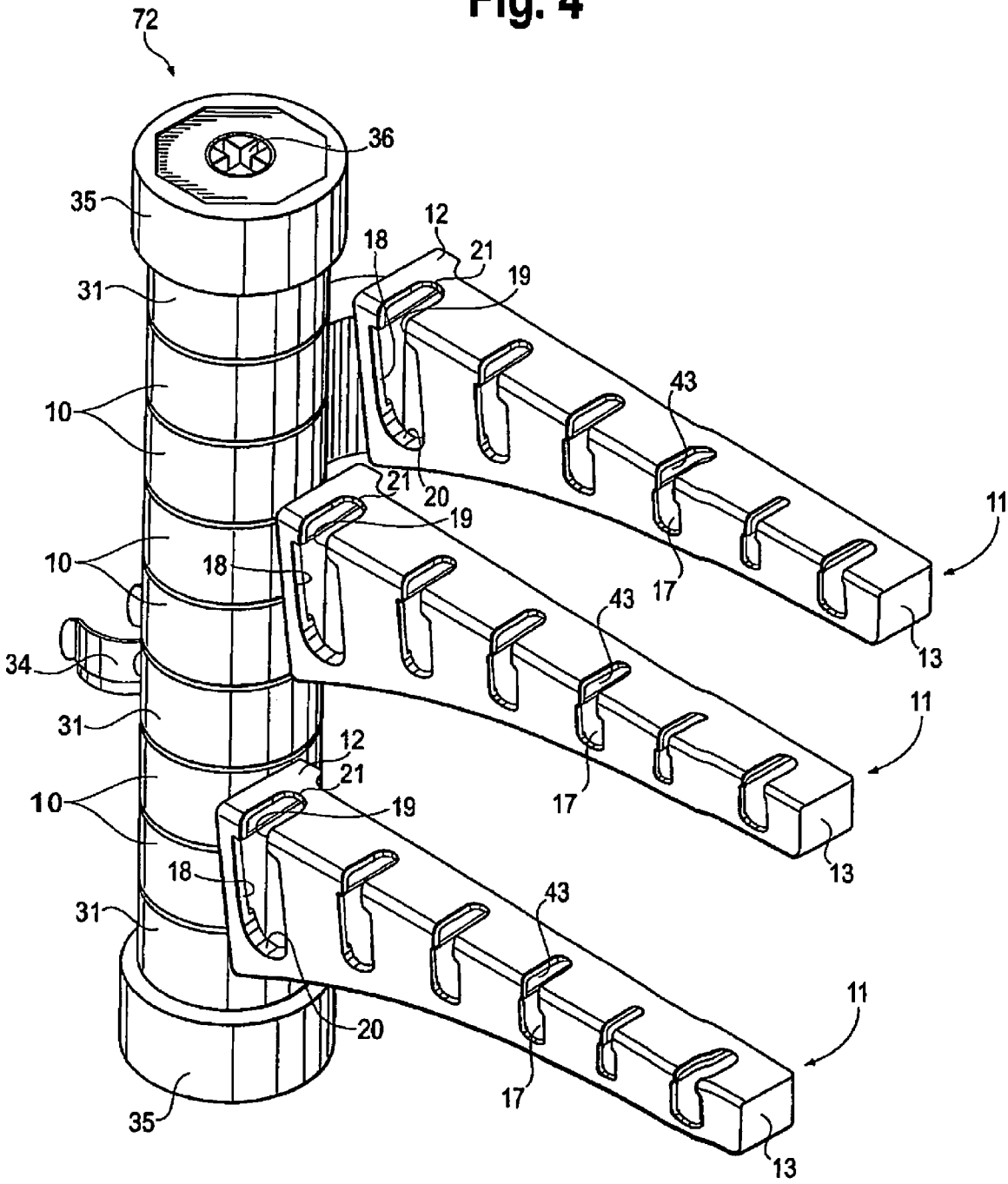
FIG. 4 is an assembly view of FIG. 3.

FIGS. 3 and 4 illustrate a plurality of the coupling rings (10) and the spacers (31) alternatively mounted on the hollow upright pivot shaft (32) at different elevations. The hollow upright pivot shaft (32) has two ends each end capped (35). Each end cap has a plughole (36) for mounting. The coupling rings (10) and the spacers (31) each have a plurality of locating grooves (33) spaced at equal angles around the inside wall and extending in axial direction. Each spacer (31) has a clamp (34) at the periphery. The hollow upright pivot shaft (32) has a plurality of spring strips (38) formed integral with the periphery and longitudinally aligned in a line. Each spring strip (38) has the proximal end, which is the end connected to the periphery of the hollow upright pivot shaft (32) and the distal end, which is the free end provided with a raised portion (39) for engaging one locating groove (33) of one coupling ring (10) or one spacer (31). The user can turn one support arm (11) with the hand to rotate the respective coupling ring (10) on the hollow upright pivot shaft (32), so as to change the support arm (11) from one angle to another relative to the hollow upright pivot shaft (32) subject to the pitch between each two locating grooves (33). When the hand is removed from the support arm (11), the raised portion (39) of the respective spring strip (38) engages the respective locating groove (33) of the coupling ring (10) to hold the coupling ring (10) to the adjusted angular position. Further, the hollow upright pivot shaft (32) has a rib (30) provided at the periphery in line with the spring strips (38) for engaging one locating groove (33) of one coupling ring (10) to prohibit the coupling ring (10) from rotating around the hollow upright pivot shaft (32).

Figure 5:
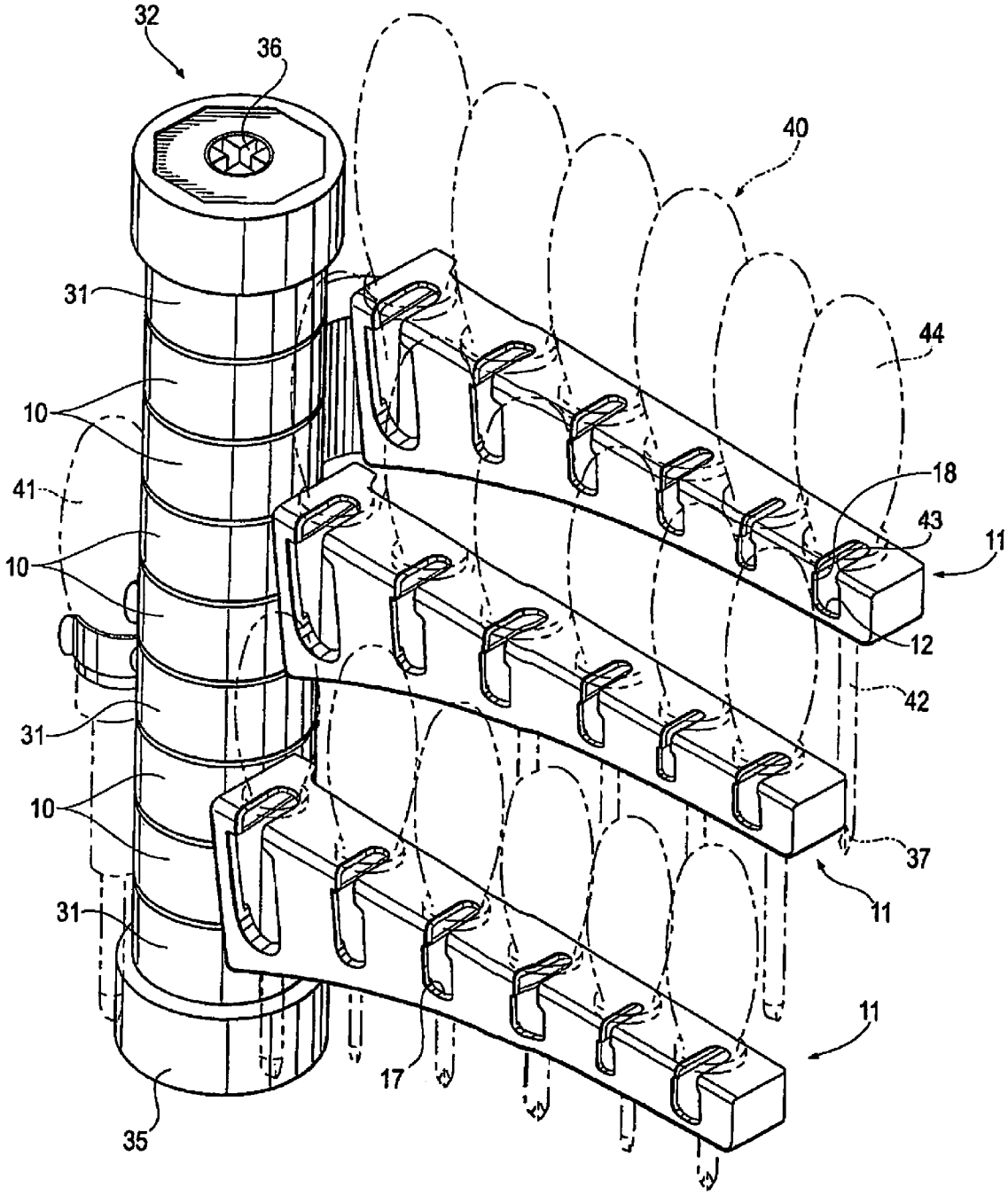
FIG. 5 illustrates a variety of hand tools set in the tool storage device of this invention.
Figure 6:
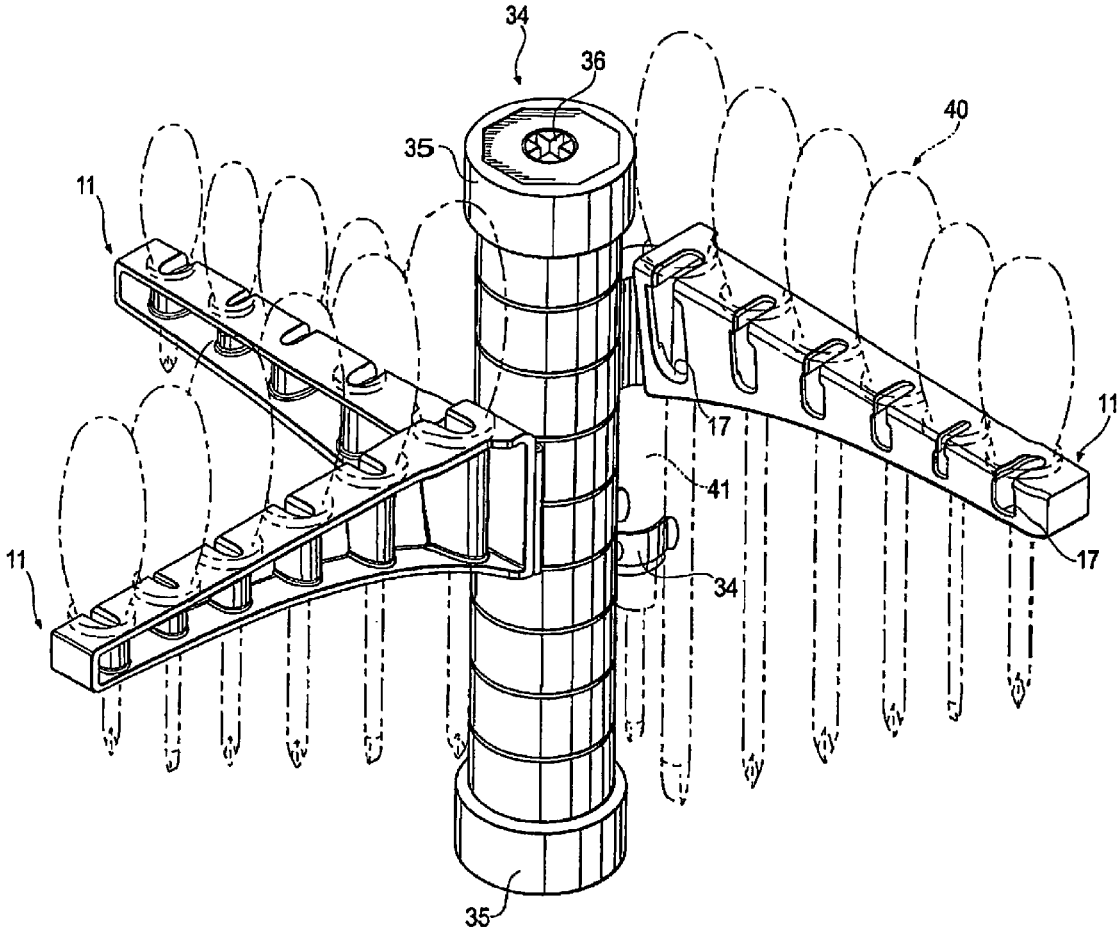
FIG. 6 is similar to FIG. 5, but illustrates the various angular positions of the adjusted support arms.

FIGS. 5 and 6 illustrate a variety of hand tools set in the tool storage device of this invention. FIG. 6 illustrates the various angular positions of the adjusted support arms (11). The hand tools (40) and (41) are respectively inserted into the receiving chambers (17) of the support arm (11) or fastened to the clamps (34) of the spacers (31). The storage hand tools (40) and (41) are kept in good order when mounting one hand tool (40) in one open receiving chamber, the tip (37) of the hand tool (40) is obliquely inserted through the front opening (18) of the respective open receiving chamber (17) and then the bottom opening (23), and then the hand tool (40), is turned vertically for the shank (42) to engage with the neck portion (43) of the respective open chamber (17) keeping the hand grip (44) of the hand tool (40) supported on the top wall (15) of the respective support arm (11). Each support arm (11) can be turned about the hollow upright pivot shaft (32) for easy arrangement of the hand tools (40).

Figure 7:
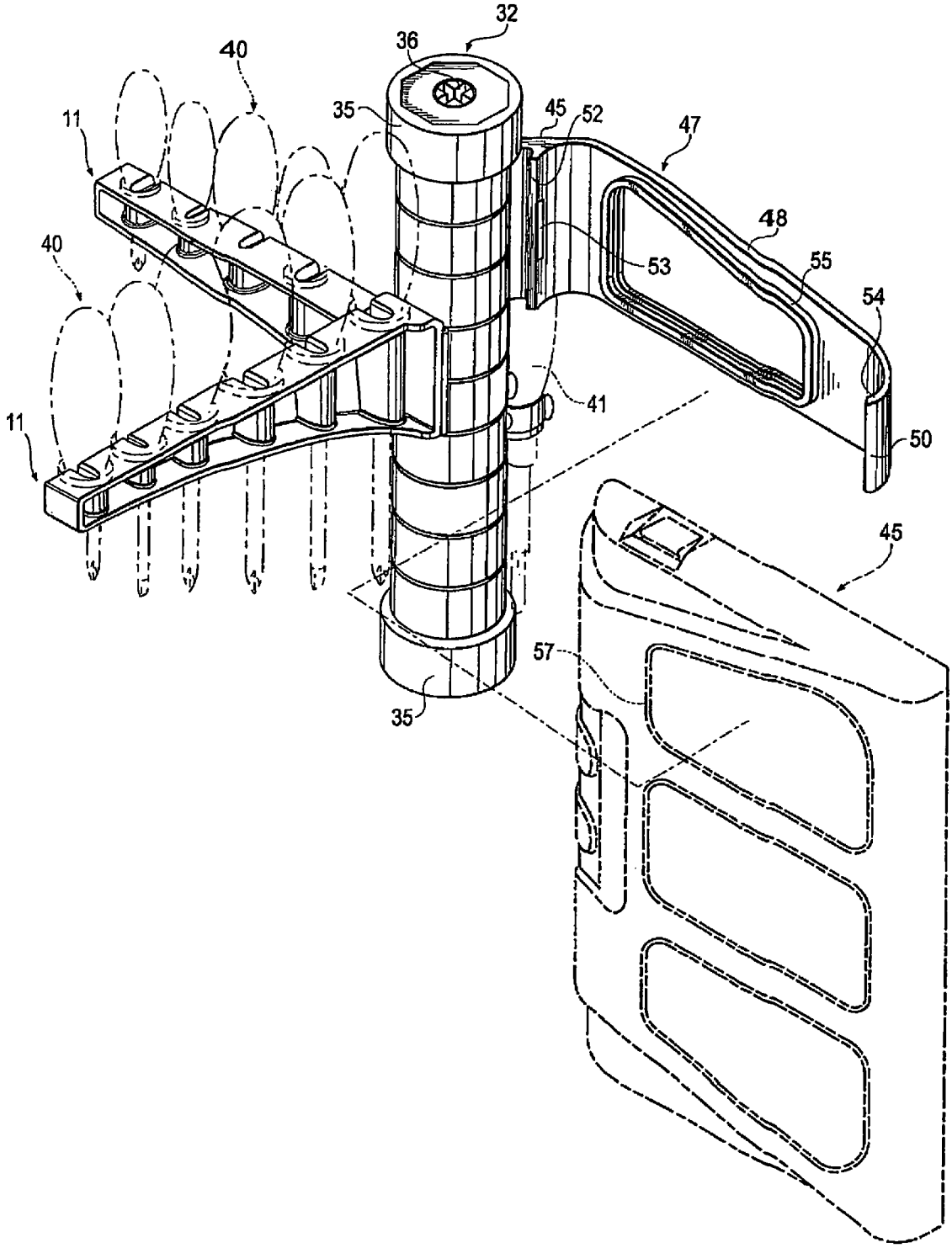
FIG. 7 is an exploded view of the tool storage device illustrating one tool rack and two support arms.
Figure 8:
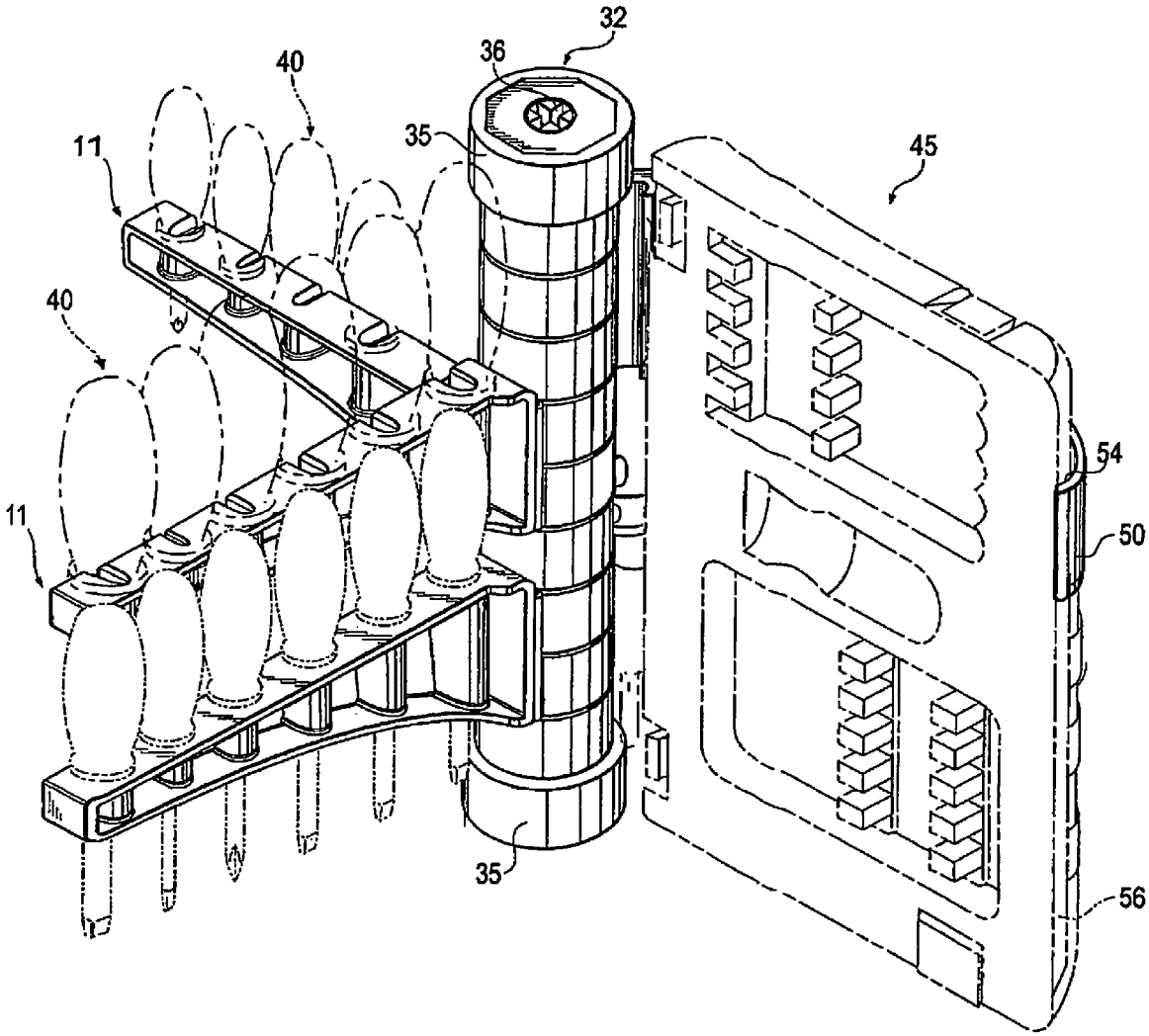
FIG. 8 is an assembly view of tool storage device of F167
Figure 9:
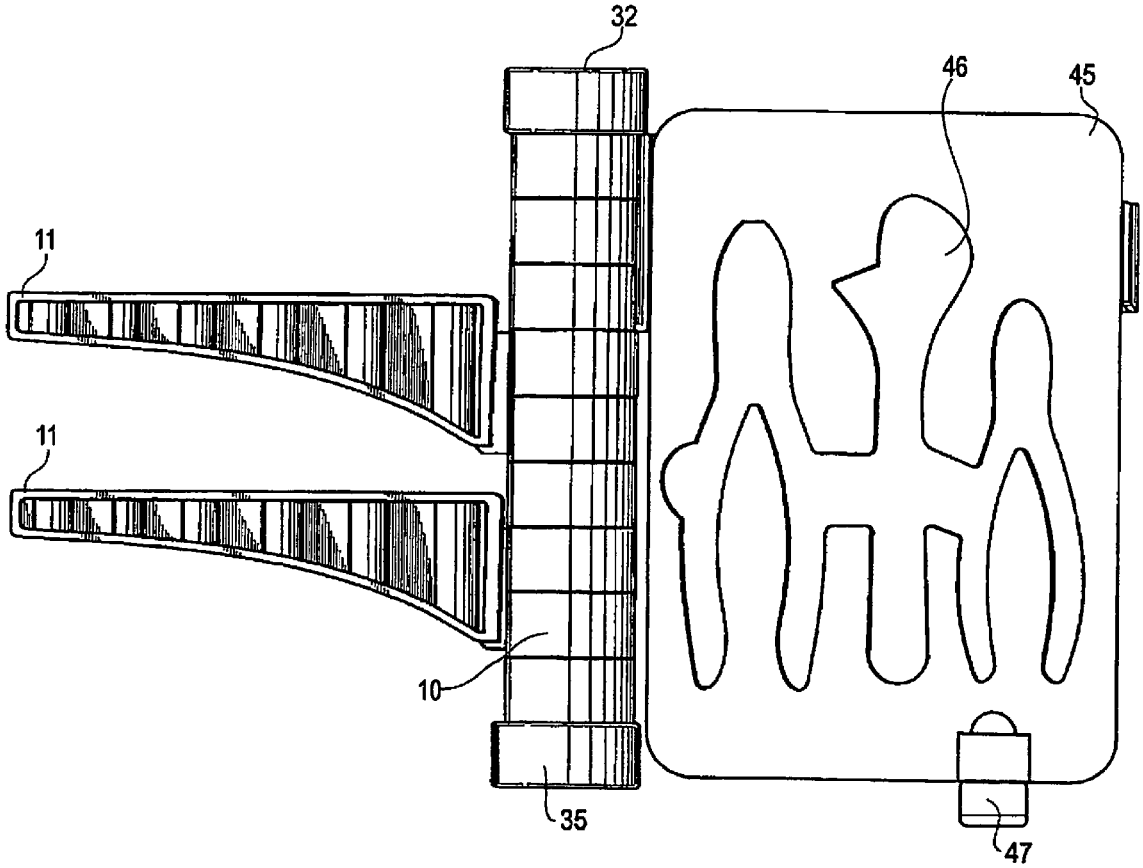
FIG. 9 is an exploded view of the tool storage device illustrating one tool rack capable of holding a pair of pliers, a wrench, and a cutting tool and two arms capable of holding screwdrivers and similar tools.

FIGS. 7, 8, and 9 illustrate one tool rack and two supporting arms.

FIG. 9 illustrates the tool storage device of this invention having one took rack (45) capable of holding a pair of pliers, a wrench and a cutting tool collectively designated hand tools (46) and two support arms (11) capable of holding screw drivers and similar tools (40). A connector (47) is mounted on the hollow upright pivot shaft (32) to hold a took rack (45). The tool rack (45) is detachably connected to the connector (47). FIGS. 7 and 8 illustrate the connector (47) comprising a coupling ring (10) coupled to the hollow upright pivot shaft (32), a flat arm (48), a neck (49) (not illustrated), ridged portion (50) transversely provided at the distal end radially extending from the periphery (51) of the coupling ring (10) and terminating at the distal end of the flat arm (48). A proximal ridged portion (52) is provided at the distal end of the flat arms (48) and connected to the neck (49). A second ridged portion (50) is provided at the distal end of the flat arm (48) and defined with the proximal ridged portion (52) and the flat arm (48) a space for accommodating the tool rack (45). A first locating rib (53) and a second locating rib (54) respectively extend along the proximal ridged portion (52) and the distal ridged portion (50). An endless protruding positioning portion (55) is provided at the flat arm (48). The tool rack (45) comprises a plurality of locating grooves (56) respectively provided at opposite sides for receiving the locating ribs (53) and (54) of connector (47). A plurality of positioning grooves (57) are provided at the bottom wall for receiving the protruding positioning portion (55).

FIGS. 10A and 10B illustrate the detachable connecting (59) and the detachable fastening structures (58).

In FIG. 10A the structures are connected by two wires (60). Apertures (68) for connecting the device to the wall are also shown. FIG. 10B illustrates the end caps (35) and connecting structures (59) and the shaft (32) without coupling rings.

FIG. 11 illustrates the connecting and fastening structures (59) and (58). The connecting structure (59) has a plug rod (69) and the fastening structure (58) has two apertures (61) through which optionally wires (60) can be drawn. Two spring locking bars (64) are equally spaced from the center guide shaft (63). Each spring locking bar (64) has a front guide face (62). The aperture (68) is shown; this is one of a pair of apertures through which the tool storage device is hanged to the wall.

FIGS. 12 and 13 illustrate the assembled connecting structure (59) and fastening structure (58) showing the plug rod (69), which will be inserted in the end cap (35) through the plughole (36). A pair of apertures (61) for wires is also shown.

Figure 14:
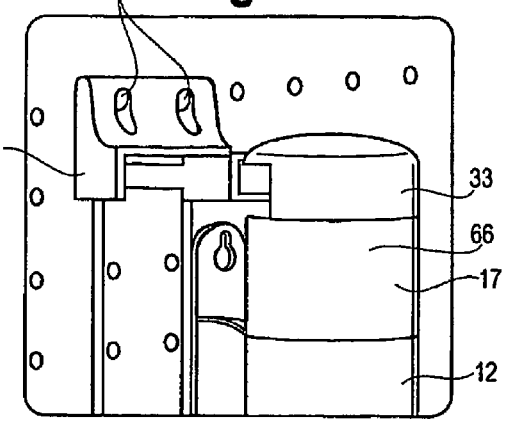
FIG. 14 illustrates the situation where the tool storage device has been attached to a wall.

FIG. 14 illustrates the tool storage device of this invention (66) attached to a wall through the apertures (68).

Figure 15:
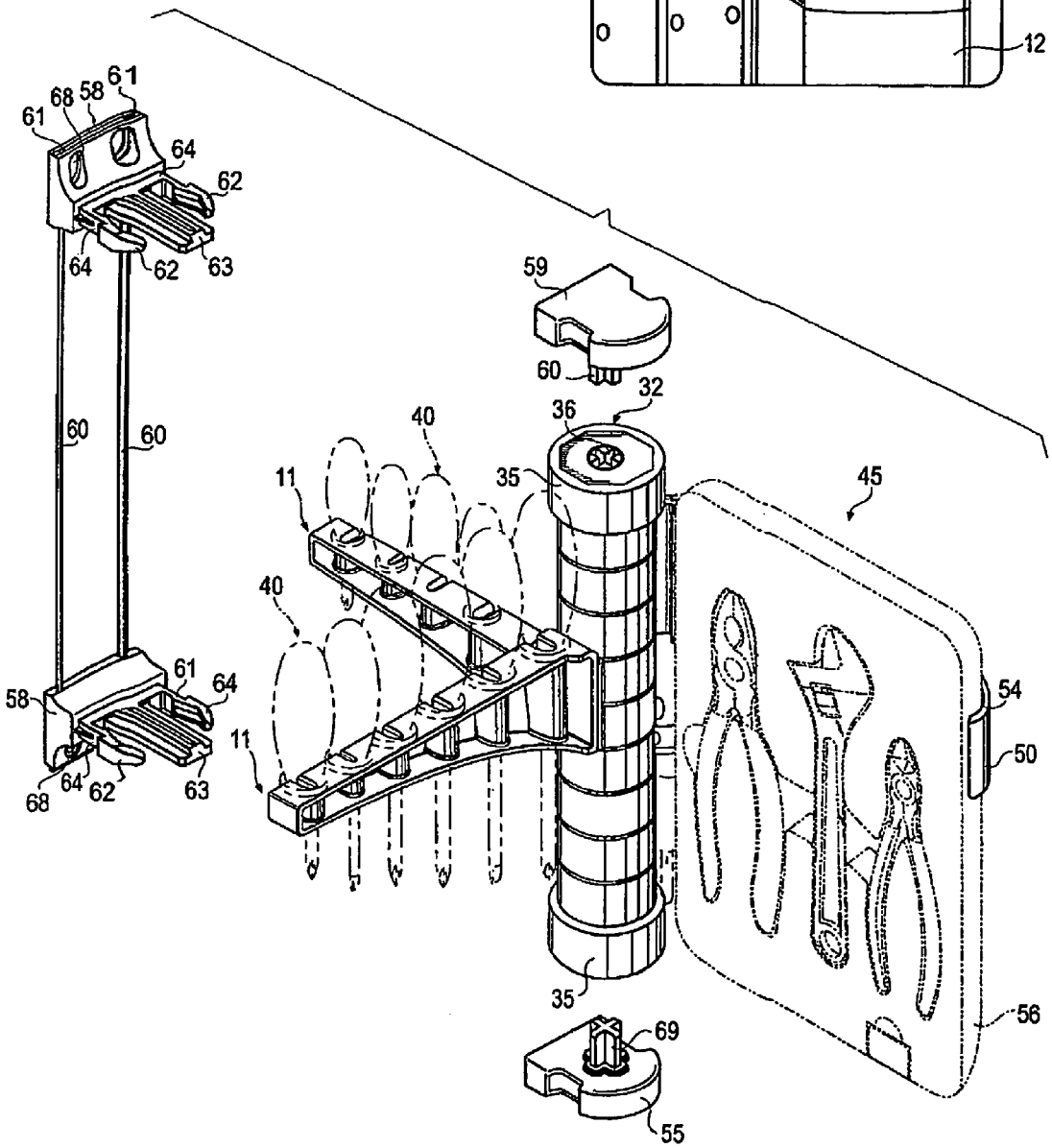
FIG. 15 illustrates one embodiment of the tool storage device of this invention showing the hollow upright pivot shaft, two arms, and one tool rack sleeving the hollow upright pivot shaft through a coupling ring. The apertures of the end cap, the connecting structures, and the fastening structures are also illustrated.

FIG. 15 illustrates the vertical tool storage device (66) the coupling rings (10) the support arms (11) the tool rack (45) and the connector (47). Also shown is the plughole (36), the end cap (35) the connecting structure, the fastening structure (58), and the plug rod (69). The fastening structure (58) has two apertures (61) through which, optionally wires (60) can be inserted. The fastening structure also has two apertures (68) used to fasten the tool storage device to a wall. Furthermore, FIG. 15 illustrates the fastening structure (58) including two spring locking bars (64), center guide shaft (63), two guide faces (62), and the connecting structure (59).

Various modifications to the invention are contemplated. It is understood, therefore, that within the scope of the appended claims, the invention may be practiced otherwise than specifically described.

What is claimed is:

1. A tool storage device comprising:

(a) a hollow upright pivot shaft having two ends, a top end and a bottom end;

(b) the hollow upright pivot shaft end capped on the top end and the bottom end; and (c) a plurality of coupling rings respectively mounted on the hollow upright pivot shaft at different elevations, and a plurality of support arms respectively coupled to the coupling rings, each of the support arms having a proximal end, a distal end, a front wall, a top wall, and a bottom wall, and a plurality of open receiving chambers respectively vertically cut through said top and bottom walls for holding hand tools, each said receiving chamber having a top opening in said top wall, and a bottom opening in said bottom wall, wherein each said support arm has a male coupling block at the proximal end thereof for coupling one coupling ring; each coupling ring has a female coupling block at the periphery thereof for receiving the male coupling block of one said support arm, and wherein the male coupling block of each said support arm has a T-shaped coupling portion; the female coupling block of each said coupling ring defines an upwardly extended T-groove for receiving the T-shaped coupling portion of the male coupling block of each said support arm.

2. The tool storage device of claim 1, wherein the front opening of each of the open chambers has a top side opened and disposed in communication with the top opening of the respective receiving open chamber, and a bottom side closed.

3. The tool storage device of claim 2, wherein each said open receiving chamber has a neck portion in said top opening.

4. The tool storage device of claim 1, wherein the male coupling blocks of the support arms are respectively extended from the proximal ends of said support arms at different angles.

5. The tool storage device of claim 4, further comprising a plurality of spacers respectively mounted on the hollow upright pivot shaft between two adjacent coupling rings.

6. The tool storage device of claim 5, wherein each spacer has a clamp at the periphery thereof for holding a hand tool.

7. The tool storage device of claim 1, wherein the open receiving chamber of each support arm and the top and the bottom openings of each open receiving chamber are made gradually smaller in the direction from the proximal end toward the distal end.

8. The tool storage device of claim 1, wherein each support arm has a thickness made gradually smaller in the direction from the proximal end to the distal end.

9. A tool storage device, comprising:

(a) a hollow upright pivot shaft having two ends, a top end and a bottom end;

(b) the hollow upright pivot shaft end capped on the top end and the bottom end; and (c) a plurality of coupling rings respectively mounted on the hollow upright pivot shaft at different elevations, and a plurality of support arms respectively coupled to the coupling rings, each of the support arms having a proximal end, a distal end, a front wall, a top wall, and a bottom wall, and a plurality of open receiving chambers respectively vertically cut through said top and bottom walls for holding hand tools, each said receiving chamber having a top opening in said top wall, and a bottom opening in said bottom wall, wherein each coupling ring has a plurality of locating grooves spaced at equal angles around the inner diameter and axially extend to the top and the bottom sides thereof; the hollow upright pivot shaft comprises a plurality of spring strips longitudinally aligned on the periphery in a line for holding said coupling rings in position, each said spring strip having a free end provided with a raised portion for engaging a locating groove of a coupling ring.

10. A tool storage device, comprising:

(a) a hollow upright pivot shaft having two ends, a top end and a bottom end;

(b) the hollow upright pivot shaft end capped on the top end and the bottom end; and (c) a plurality of coupling rings respectively mounted on the hollow upright pivot shaft at different elevations, and a plurality of support arms respectively coupled to the coupling rings, each of the support arms having a proximal end, a distal end, a front wall, a top wall, and a bottom wall, and a plurality of open receiving chambers respectively vertically cut through said top and bottom walls for holding hand tools, each said receiving chamber having a top opening in said top wall, and a bottom opening in said bottom wall, wherein the hollow upright pivot shaft further comprises a rib provided at the periphery thereof in line with and between two spring strips for engaging one locating groove of the coupling ring to stop the coupling ring from rotation relative to the hollow upright pivot shaft.

* * * * *